United States Patent [19]

Buess et al.

[11] Patent Number: 4,868,952

[45] Date of Patent: Sep. 26, 1989

[54] OPENING CYLINDER

[76] Inventors: Heinz Buess, St. Albanring 174, CH-4052 Basel, Switzerland; José A. Saporta, 24 bis, rue Remilly, F-78000 Versailles, France

[21] Appl. No.: 146,372

[22] PCT Filed: Mar. 27, 1987

[86] PCT No.: PCT/CH87/00037

§ 371 Date: Dec. 9, 1987

§ 102(e) Date: Dec. 9, 1987

[87] PCT Pub. No.: WO87/06276

PCT Pub. Date: Oct. 22, 1987

[30] Foreign Application Priority Data

Apr. 10, 1986 [CH] Switzerland ..... 01424/86

[51] Int. Cl.[4] ..... D01H 7/895

[52] U.S. Cl. ..... 19/112; 19/233

[58] Field of Search ..... 19/97, 112, 54, 233

[56] References Cited

U.S. PATENT DOCUMENTS

| | | | |
|---|---|---|---|
| 2,115,605 | 4/1938 | Allen et al. | 19/112 |
| 2,832,098 | 4/1958 | Mee | 19/112 X |
| 3,646,639 | 3/1972 | Burckhardt et al. | 19/97 |
| 4,625,366 | 12/1986 | Egerer | 19/97 |
| 4,627,131 | 12/1986 | Iwata | 19/112 X |

FOREIGN PATENT DOCUMENTS

| | | |
|---|---|---|
| 0161414 | 11/1975 | Czechoslovakia . |
| 161415 | 11/1975 | Czechoslovakia . |
| 0141283 | 5/1985 | European Pat. Off. . |
| 0178614 | 4/1986 | European Pat. Off. . |
| 2045863 | 4/1971 | Fed. Rep. of Germany . |
| 2159230 | 7/1972 | Fed. Rep. of Germany . |
| 2520706 | 11/1976 | Fed. Rep. of Germany . |
| 1295871 | 5/1962 | France . |
| 2374441 | 7/1978 | France . |
| 46-24661 | 8/1971 | Japan . |
| 51-53297 | 12/1976 | Japan . |
| 57-74987 | 5/1982 | Japan . |
| 61-59676 | 4/1986 | Japan . |
| 1556090 | 11/1979 | United Kingdom . |

*Primary Examiner*—Werner H. Schroeder
*Attorney, Agent, or Firm*—Peter K. Kontler

[57] ABSTRACT

A device for treating fibers includes a cylindrical support having an axis of rotation. The support has a circular outer peripheral surface and carries a set of combs which extend parallel to the rotational axis of the support. The combs are mounted on the support in such a way that the spine of each comb is held by the support with the teeth located radially outward of the peripheral surface of the support. The spines of the combs all project radially outward of such peripheral surface by the same distance.

18 Claims, 2 Drawing Sheets

OPENING CYLINDER

The present invention relates to an opening cylinder having opening combs on its peripheral surface.

An opening cylinder of this type is described in the British patent specification 1 556 090. The spines of the opening combs, which have a predominantly circular cross section, are mounted in corresponding grooves of the cylinder for rotation about their longitudinal axes and are held at a predetermined tilt by interchangeable, removable plates of specific shape. Instead of keeping several opening cylinders at the bearing with different needle inclinations for different fiber materials, it is sufficient with this conventional device to have different plates at the bearing for different needle inclinations. This known opening cylinder is, however, so expensive to manufacture that it is more economical to keep an appropriate opening cylinder at the bearing for each fiber material. Its advantage is that the cylinder need not be discarded when needles become defective but that, instead, the opening combs can be individually changed without renewed balancing of the cylinder.

Other opening cylinders of this type are described, for example, in the German publication 2 045 863, the German publication 2 159 230, the German publication 2 520 706, the European patent application 178 614, CS-A 161 414, the Czechoslovakian publication CS-A 161 415, the Japanese publication 46-24661, the Japanese publication 51-53297, the Japanese publication 57-74987 and the Japanese publication 61-59676. In order to improve opening of the fibers and thereby reduce the number of defects in the subsequently spun yarn, various means have been proposed to facilitate stripping of the fibers from the opening cylinder and advancement to the spinning rotor. To this end, the Czechoslovakian publication CS-A 161 414, for instance, illustrates toothed ejecting elements which are disposed between the opening combs. In this manner, the friction between the fibers and the spines of the combs is also to be reduced and, for this purpose, the spines of the toothed ejecting elements project radially beyond the peripheral surfaceof the cylinder to a greater extent than the spines of the opening combs. In the opening cylinder of the Czechoslovakian publication CS-A 161 415, consecutive opening combs project radially beyond the peripheral surface of the cylinder by an increasing distance so that the fibers are forcibly moved outwards and thus are more easily separated from the opening cylinder. Similarly, it is known to provide the peripheral surface of the cylinder with radial holes (e.g., French publication 1 295 871) in order to separate the fibers from the opening cylinder with radical air currents.

All of the proposals contained in the above prior art have, however, brought only slight improvements in yarn produced by the open spinning process.

The object of the present invention is to improve an opening cylinder of the foregoing type in such a manner that an improvement in quality can be obtained therewith for different yarns produced by the open spinning process while maintaining the advantage of a simple construction.

In accordance with the invention, this object is achieved by having the comb spines project uniformly beyond the peripheral surface of the opening cylinder.

The invention is described by way of example with reference to the accompanying schematic drawings where:

Figure 2:
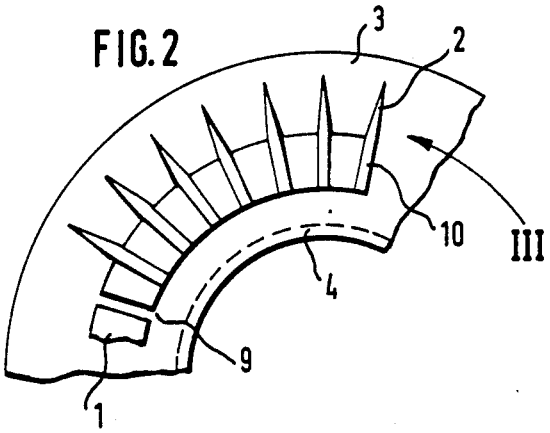
FIG. 2 is a fragmented view in the direction of the arrow II of FIG. 1.
Figure 4:
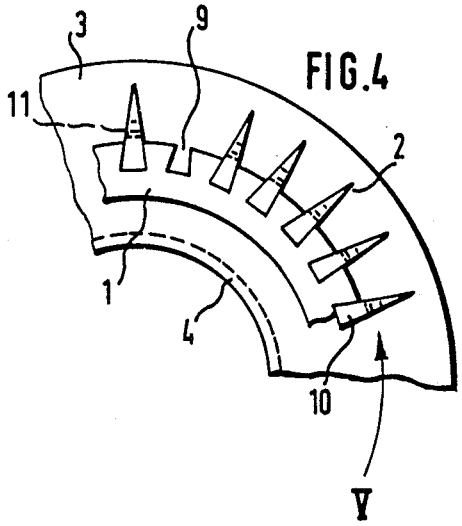
Figure 3:
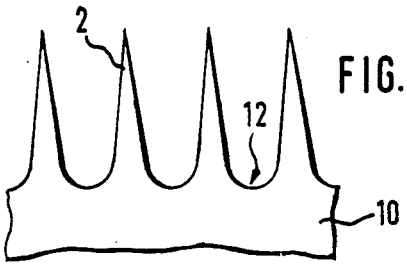
Figure 5:
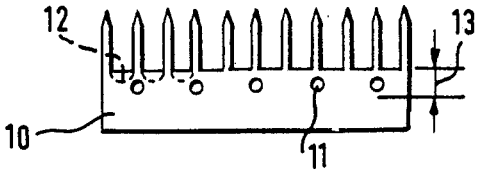
Figure 6:
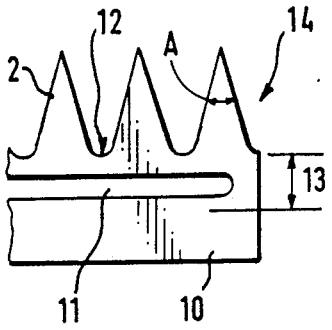
Figure 7:
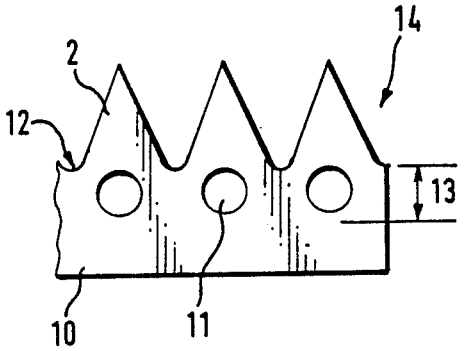
Figure 8:
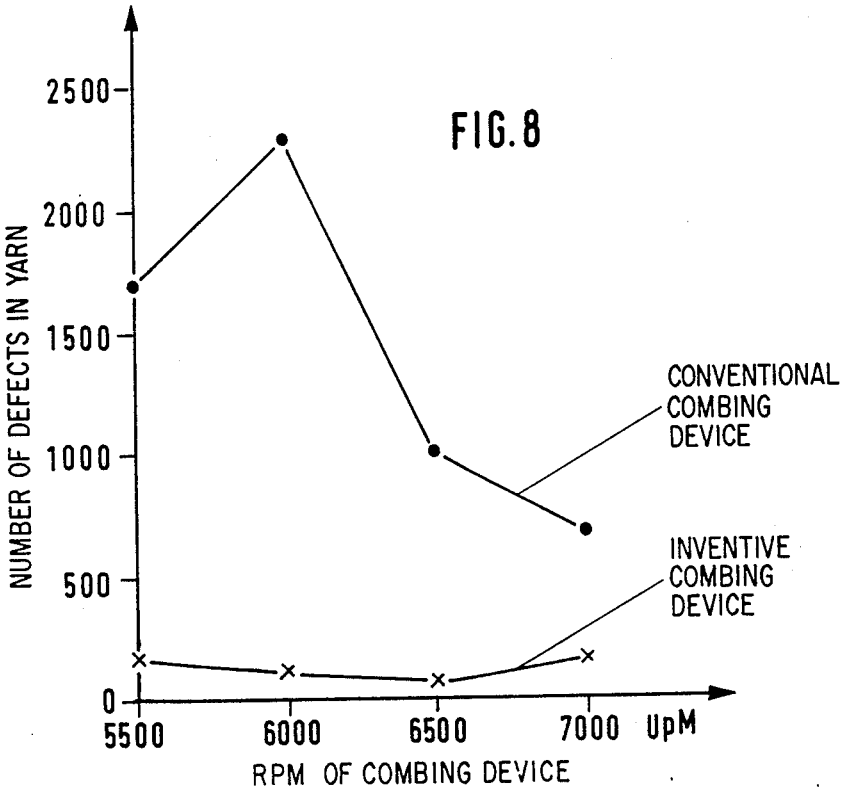

FIG. 3 is an enlarged illustration of a fragment of an opening comb viewed in the direction of arrow III of FIG. 2, FIG. 4 is a view similar to FIG. 2 of a second exemplary embodiment of the opening comb, FIG. 5 is a view of an opening comb according to FIG. 4 in the direction of the arrow V, FIG. 6 is a fragment of a third exemplary embodiment of an opening comb viewed in accordance with the arrow III of FIG. 2, FIG. 7 is a fragment of a fourth exemplary embodiment of an opening comb viewed according to the arrow III of FIG. 2, and FIG. 8 is a graphic representation of the defects in yarn as a function of the rotational speed of the opening cylinder.

Figure 1:
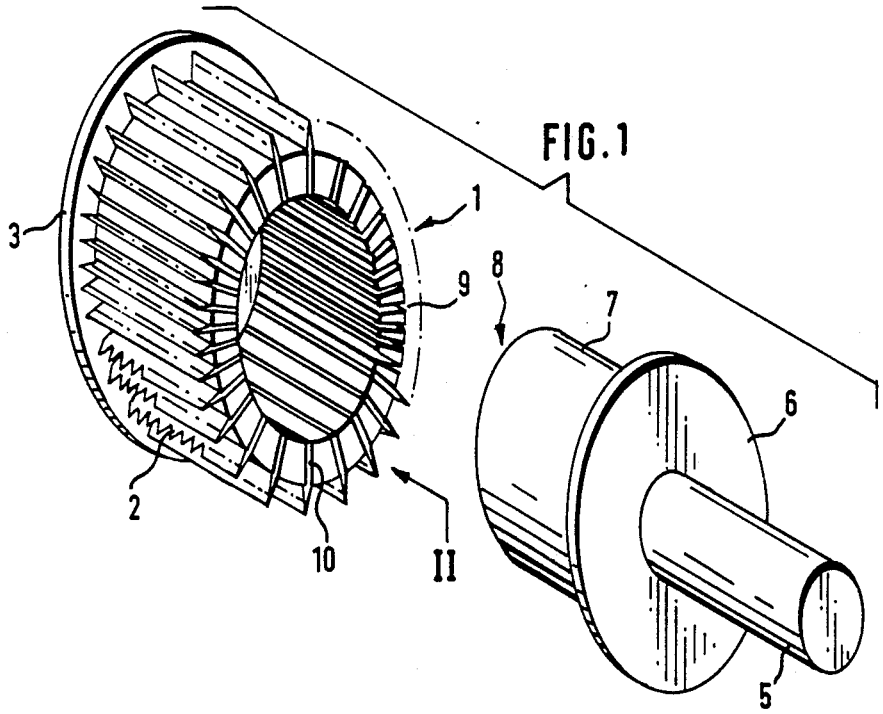
FIG. 1 is a perspective exploded view of an opening cylinder.

The two- or three-piece opening cylinder in FIG. 1 has a cylindrical part 1 the periphery of which is occupied by parallel rows of needles or teeth 2. An annular disc 3 with a bayonet groove 4 cut into its inner circumference is fast with the part 1. The opening cylinder further includes a stub shaft 5 which is rotatably mounted in a non-illustrated bearing and has an annular disc 6, as well as a sleeve 7, rigidly affixed thereto. At its free end 8, the sleeve 7 carries bayonet pins which are connectable with the bayonet groove 4. During assembly of the opening cylinder, the sleeve 7 is pushed into the annular disc 3 and rotated until the annular disc 6 is firmly held against the side of the cylindrical part 1.

Parallel slits or grooves 9 are provided in the cylindrical part 1. A comb sping 10 carrying the needles or teeth 2 is secured in each of these by form locking, force locking and/or material locking. A comb spine 10 with the associated teeth 2 constitutes an opening comb 14. The needles or teeth 2 are advantageously pointed. The comb spines 10 can consist of synthetic resin or metal and can be held in the slits 9 by friction or adhesively. They can, however, also (FIGS. 4 and 5) have a dovetail-shaped cross section at the base and be held in correspondingly formed grooves 9 in which case the comb spines 10 and teeth 2 are of one piece. With this design, the comb spines 10—when the annular disc 6 has been removed—can be laterally pushed out of the slits of grooves 9 and, in this manner, damaged needles or rows of teeth can be replaced without necessitating a renewed balancing of the opening cylinder. The teeth 2 advantageously have the same height. This is at least 1.5 millimeter, advantageously 2 to 4 millimeters.

As shown in the drawings, the comb spines 10 project uniformly beyond the periphery of the cylindrical part 1 and at least one opening 11 can be provided in the projecting portions. The comb spines 10 project at least 1 millimeter (reference numeral 13) beyond the peripheral surface of the cylindrical part 1 and the openings 11 are always oriented in the direction of rotation regardless of the inclination of the teeth 2. During opening of a fibrous strand, the openings 11 create a flow of air which reduces the fibermetal friction and, consequently, the formation of dust by abrasion and the deposition of dust from the fibers on the cylinder.

The needles or teeth 2 are connected to the comb spines 10 in such a manner that, after installation in the opening cylinder, they are either perpendicular to the direction of rotation (radially oriented) or inclined in the direction of rotation. The design of the needle or tooth array can, of course, be selected in accordance with the fiber material to be processed.

As illustrated by broken lines in FIG. 5 and with full lines in FIGS. 3, 6 and 7, the comb spines 10 can have a concave arc 12 between the needles or teeth 2. The fact that the upper edges of the comb spines 10 are raised above the peripheral surface of the cylindrical part 1 has the effect that the contact area between the opening cylinder, on the one hand, and the fiber material, on the other hand, is very small (since the fiber material does not touch the peripheal surface of the cylindrical part 1). This results in a corresponding reduction of damage to the fibers.

A vertex angle of at least 10° is advantageously selected for the teeth 2 according to FIG. 6. The radial distance 13 of the teeth 2 or the upper edges of the comb spines 10 from the peripheral surface of the cylindrical part 1 is at least 1 millimeter.

Although the favorable effect of the openings 11 cannot be fully explained physically, it is assumed that they create an improved air layer or a better flow of air between the peripheral surface of the cylindrical part 1, on the one hand, and the fiber fleece, on the other hand. The openings 11 perhaps reduce air turbulence beyond the rows of teeth and thereby enhance the tendency of the fibers to become aligned in parallelism. It has been found that the openings 11 themselves provide an improvement.

With conventional opening cylinders having a radius of 30 millimeters and rotating at 7,000 rpm, a 40 millimeter fiber contacts the peripheral surface of the opening cylinder over a length of approximately 110 meters when the fleece is advanced at a speed of 34 cm/min. With the opening cylinder according to the invention, frictional contact between the fibers and the peripheral surface of the cylindrical part 1 is eliminated and restricted to the narrow upper sides of the comb spines so that the contact length is reduced to about 35 meters. This reduction in frictional length produces a substantial improvement in quality with respect to the spun yarn. In addition, the improved combing effect of the opening cylinder in accordance with the invention allows the rotational speed to be significantly reduced without thereby affecting opening of the fiber fleece. This reduces the contact length to approximately 25 meters.

By means of the opening cylinder described above, the number of defects per 100,000 meters of spun yarn from an open spinning machine is substantially reduced in comparison to conventional opening cylinders. The abscissa in FIG. 8 represents the rotational speed of the opening cylinder and the ordinate the number of defects in the spun yarn. The upper curve shows the number of defects for a conventional opening cylinder as a function of its rotational speed while the lower curve shows the number of defects of an opening cylinder according to the invention. This comparison illustrates that the number of defects is very significantly reduced, especially at lower operating speeds of the opening cylinder.

We claim:

1. A device for treating fibers, comprising a support having a substantially circular outer peripheral surface; and a plurality of combs mounted on said support, each of said combs including a spine element and a row of teeth carried by the respective element and located outwardly of said surface, all of said elements projecting outwardly of said surface by substantially the same distance, and each of said elements being of one piece with the respective teeth.

2. The device of claim 1, wherein said support is substantially cylindrical.

3. The device of claim 1, wherein said rows are substantially parallel to one another.

4. The device of claim 1, wherein said surface is provided with a plurality of slits ane each of said elements is received by a respective slit.

5. The device of claim 1, each of said elements having a portion which is disposed outwardly of said surface; and wherein at least one of said portons is provided with an opening.

6. The device of claim 5, said support having an axis of rotation; and wherein said opening faces in a direction transverse to said axis.

7. The device of claim 1, wherein said teeth are pointed.

8. The device of claim 1, wherein each pair of neighboring teeth defines a valley and said valleys are rounded.

9. The device of claim 8, wherein said valleys are concave.

10. The device of claim 1, wherein each of said elements comprises a plurality of discrete sections and each of said sections is provided with at least one tooth.

11. The device of claim 10, wherein the respective sections of each element are connected to one another.

12. The device of claim 11, wherein the respective sections of each element are adhesively bonded to one another.

13. The device of claim 10, wherein each of said sections is of one piece with the respective tooth.

14. The device of claim 1, wherein said teeth are constituted by needles.

15. The device of claim 14, wherein said needles are substantially flat.

16. The device of claim 1, wherein said teeth have a length of about 1.5 to about 4 millimeters.

17. The device of claim 16, wherein said length is about 2 to about 4 millimeters.

18. A device for treating fibers, comprising a support having a substantially circular outer peripheral surface and an axis of rotation; and a plurality of combs mounted on said support, each of said combs including a spine element and a row of teeth carried by the respective element and located outwardly of said surface, all of said elements projecting outwardly of said surface by substantially the same distance and each of said elements having a portion which is disposed outwardly of said surface, at least one of said portions being provided with an opening, and said opening facing in a direction transverse to said axis.

* * * * *